US010316697B2

(12) United States Patent
Wang et al.

(10) Patent No.: US 10,316,697 B2
(45) Date of Patent: Jun. 11, 2019

(54) STEAM TURBINE EXHAUST CHAMBER COOLING DEVICE AND STEAM TURBINE

(71) Applicant: KABUSHIKI KAISHA TOSHIBA, Minato-ku (JP)

(72) Inventors: Xiaolan Wang, Yokohama (JP); Yasuteru Kawai, Kawasaki (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 365 days.

(21) Appl. No.: 15/173,015

(22) Filed: Jun. 3, 2016

(65) Prior Publication Data

US 2016/0356183 A1 Dec. 8, 2016

(30) Foreign Application Priority Data

Jun. 5, 2015 (JP) ..... 2015-114531
Feb. 16, 2016 (JP) ..... 2016-026858

(51) Int. Cl.
*F01D 25/12* (2006.01)
*F01D 25/30* (2006.01)

(52) U.S. Cl.
CPC ..... *F01D 25/305* (2013.01); *F01D 25/12* (2013.01); *F05D 2220/31* (2013.01); *F05D 2260/212* (2013.01)

(58) Field of Classification Search
CPC ..... F01D 25/12; F01D 25/14; F01D 25/305; F05D 2220/31; F05D 2260/221; F05D 2260/2214; F05D 2260/212; F01K 21/005; F01K 19/10
See application file for complete search history.

(56) References Cited

U.S. PATENT DOCUMENTS 3,885,822 A * 5/1975 Cohen ..... F01D 21/00 239/1

FOREIGN PATENT DOCUMENTS

| | | |
|---|---|---|
| JP | 63-132804 U | 8/1988 |
| JP | 5-202702 | 8/1993 |
| JP | 6-137111 | 5/1994 |
| JP | 6-193408 | 7/1994 |

OTHER PUBLICATIONS

English machine translation of JP-05-003687Y, May 1993.*
English machine translation of JP-05-202702A, Aug. 1993.*

* cited by examiner

*Primary Examiner* — Christopher Verdier
(74) *Attorney, Agent, or Firm* — Oblon, McClelland, Maier & Neustadt, L.L.P.

(57) ABSTRACT

A steam turbine exhaust chamber cooling device includes a plurality of spray nozzles, and the plurality of spray nozzles inject spray water from an injection port to the turbine exhaust chamber. Here, a center line of the injection port is inclined with respect to a radial direction of a turbine rotor so that the plurality of spray nozzles inject the spray water in a direction counter to a rotation direction of the turbine rotor. An inclination angle α at which the center line of the injection port is inclined to a forward side of the rotation direction with respect to the radial direction of the turbine rotor is in a relationship represented by the following formula (A), $$25° \leq \alpha \leq 45° \quad \text{(A).}$$

3 Claims, 16 Drawing Sheets

STEAM TURBINE EXHAUST CHAMBER COOLING DEVICE AND STEAM TURBINE

CROSS REFERENCE TO RELATED APPLICATIONS

This application is based upon and claims the benefit of priority from Japanese Patent Application No. 2015-114531 filed on Jun. 5, 2015, and Japanese Patent Application No. 2016-026858 filed on Feb. 16, 2016; the entire contents of which are incorporated herein by reference.

FIELD

Embodiments described herein relate generally to a steam turbine exhaust chamber cooling device and a steam turbine.

BACKGROUND

In a steam turbine, operation under a very low load in which a load is extremely lower than a rated load or operation under no load is performed. When the operation of the steam turbine is performed under the very low load or no load, the temperature of a blade constituting a turbine stage at a final stage in the steam turbine such as a low-pressure turbine is increased by windage loss.

FIG. 8 is a diagram illustrating the relationship (temperature distribution) between a temperature T of stream which flows through a rotor blade at the final stage and a position H in a radial direction and the relationship (flow rate distribution) between a flow rate FR of the steam which flows through the rotor blade at the final stage and the position H in the radial direction in a steam turbine according to a related art.

In FIG. 8, a horizontal axis represents the temperature T or the flow rate FR. A vertical axis represents the position H in the radial direction (blade height direction position). On the vertical axis, a position H1 represented at a lower side is the inside in the radial direction and corresponds to a position of a root side of the rotor blade. Then, on the vertical axis, a position H2 represented at an upper side is the outside in the radial direction and corresponds to a position of a tip side of the rotor blade. FIG. 8 illustrates a result for the operation under a very low load of about 5%. This load is a load less than a minimum load of loads under which continuous operation is allowed (continuous operation allowable minimum load).

At a very low load operation illustrated in FIG. 8 or at a time of no load operation, on the rotor blade at the final stage, a positive flow rate FR (flow from an inlet toward an outlet) exists only at the tip side (the upper side in FIG. 8), and a negative flow rate FR (counter flow from the outlet toward the inlet) exists on a large region of the root side (the lower side in FIG. 8). Accordingly, it is known that a temperature increase occurs around the rotor blade at the final stage and in an exhaust chamber compared with normal operation. In particular, the temperature T of the stream which flows through the tip side becomes higher than that of the stream which flows through the root side due to centrifugal force caused by rotation of the rotor blade. That is, high-temperature stream flows to be biased to the tip side of the rotor blade at the final stage. As a result, the temperature of a tip portion becomes significantly high on the rotor blade at the final stage.

In order to cope with this event, a steam turbine exhaust chamber cooling device is placed in the steam turbine. The steam turbine exhaust chamber cooling device performs cooling by spraying spray water into a turbine exhaust chamber provided inside a casing. Thereby, temperatures of the exhaust chamber and the rotor blade are decreased, and the rotor blade is protected.

FIG. 9, FIG. 10, and FIG. 11 are views illustrating substantial parts of the steam turbine according to the related art.

FIG. 9, FIG. 10, and FIG. 11 illustrate the parts in which a turbine exhaust chamber K2 to which the steam which flows through the turbine stage at the final stage is exhausted and a steam turbine exhaust chamber cooling device 5 are provided inside a casing 2. In FIG. 9 and FIG. 10, an upper half portion of a steam turbine 1 is illustrated, and illustration of a lower half portion thereof is omitted. On the other hand, in FIG. 11, both the upper half portion and the lower half portion are illustrated.

Specifically, FIG. 9 illustrates a cross section of a plane corresponding to a Z1-Z2 portion in FIG. 11, and illustrates a vertical plane (y-z plane) defined by a horizontal direction (y direction) along a rotation axis AX and a vertical direction (z direction). FIG. 10 illustrates a cross section of a plane corresponding to a Z1*a*-Z2*a* portion in FIG. 11, and illustrates a plane defined by the horizontal direction (y direction) along the rotation axis AX and a direction along a radial direction of the rotation axis AX (rd direction). FIG. 11 illustrates a cross section of a plane corresponding to Y1-Y2 portions in FIG. 9 and FIG. 10, and illustrates a vertical plane (x-z plane) defined by another horizontal direction (x direction) orthogonal to the horizontal direction (y direction) along the rotation axis AX and the vertical direction (z direction).

Note that in FIG. 10, spray water S5 which the steam turbine exhaust chamber cooling device 5 supplies is indicated using thick solid line arrows. Further, in FIG. 11, a rotation direction R of a turbine rotor 3 is indicated using a dotted line arrow.

As illustrated in FIG. 9 and FIG. 10, the steam turbine 1 has the casing 2, the turbine rotor 3, and the steam turbine exhaust chamber cooling device 5. Although illustration is omitted, the steam turbine 1 is a multistage axial flow turbine, and a plurality of turbine stages are juxtaposed along the rotation axis AX of the turbine rotor 3. That is, in the steam turbine 1, a rotor blade cascade and a stationary blade cascade are each arranged at a plurality of stages alternately along the rotation axis AX inside the casing 2.

In the steam turbine 1, the steam flows into the inside of the casing 2 from an inlet (not illustrated) thereof as working fluid. The steam turbine 1 is, for example, the low-pressure turbine, and the stream which sequentially flows through a high-pressure turbine and an intermediate-pressure turbine flows thereinto as the working fluid. Then, the working fluid which flows thereinto flows sequentially through the plurality of turbine stages juxtaposed along the rotation axis AX inside the casing 2. The working fluid expands to work at each of the turbine stage at an initial stage to the turbine stage at the final stage. Thereby, the turbine rotor 3 rotates about the rotation axis AX inside the casing 2. Then, the working fluid flows out of the turbine stage at the final stage and is thereafter discharged via the turbine exhaust chamber K2 from an outlet (not illustrated) of the casing 2 to the outside. The working fluid discharged from the casing 2 flows into a steam condenser (not illustrated) provided in a lower portion of the steam turbine 1, for example.

Each part constituting the steam turbine 1 will be sequentially described.

The casing 2 in the steam turbine 1 has, for example, a double structure and has an inner casing 21 and an outer casing 22 as illustrated in FIG. 9 and FIG. 10. In the casing 2, the outer casing 22 houses the inner casing 21 thereinside.

Besides the above-described parts, as illustrated in FIG. 9, FIG. 10, and FIG. 11, an outer peripheral flow guide 23, an inner peripheral flow guide 24, and a partition plate 25 are placed in the casing 2.

The outer peripheral flow guide 23 and the inner peripheral flow guide 24 are a conical tubular body and placed inside the turbine exhaust chamber K2 so that their tube axes correspond with the rotation axis AX as illustrated in FIG. 9, FIG. 10, and FIG. 11. Here, the outer peripheral flow guide 23 is fixed to the inner casing 21. The inner peripheral flow guide 24 is arranged inside the outer peripheral flow guide 23 and fixed to the outer casing 22. Both the outer peripheral flow guide 23 and the inner peripheral flow guide 24 constitute a diffuser and expand the working fluid smoothly in the radial direction of the rotation axis AX.

The partition plate 25 is a plate-shaped body and placed inside the outer casing 22 as illustrated in FIG. 9 and FIG. 11. Here, the partition plate 25 is provided inside the turbine exhaust chamber K2 on an upper half side of the outer casing 22. The partition plate 25 is placed so that its surface is along the vertical direction (z direction) passing through the rotation axis AX of the turbine rotor 3.

In the steam turbine 1, a rotor blade 31 is provided on the turbine rotor 3 as illustrated in FIG. 9, FIG. 10, and FIG. 11. Although illustration is omitted, a plurality of rotor blades 31 are arranged at intervals along the rotation direction R of the turbine rotor 3.

The steam turbine exhaust chamber cooling device 5 in the steam turbine 1 is placed inside the casing 2 as illustrated in FIG. 10. Here, the steam turbine exhaust chamber cooling device 5 is placed on an outer peripheral surface (upper surface in FIG. 10) of the outer peripheral flow guide 23. The steam turbine exhaust chamber cooling device 5 performs the cooling by supplying the spray water S5 (water droplets) to the turbine exhaust chamber K2. The steam turbine exhaust chamber cooling device 5 supplies the spray water S5 (water droplets) when, for example, the operation in which a turbine load is less than 20% relative to a maximum load (100%) is performed.

The steam turbine exhaust chamber cooling device 5 has spray nozzles 51 and connecting pipes 52 as illustrated in FIG. 10 and FIG. 11.

As illustrated in FIG. 10, each spray nozzle 51 is placed at the tip of a connecting pipe 52. The spray nozzle 51 sprays the spray water S5 from an injection port toward the inside of the outer peripheral flow guide 23. In the spray nozzle 51, a center line J5 of the injection port is inclined with respect to the plane orthogonal to the rotation axis AX of the turbine rotor 3, whereby a collision of the spray water S5 with the rotor blade 31 is prevented. Note that the connecting pipe 52 is coaxial with the injection port of the spray nozzle 51.

As illustrated in FIG. 11, there are a plurality of spray nozzles 51, and in the plurality of spray nozzles 51, the injection ports are symmetrically arranged with the vertical direction (z direction) passing through the rotation axis AX of the turbine rotor 3 being a symmetry axis. For example, the four spray nozzles 51 are aligned in the rotation direction R of the turbine rotor 3. The four spray nozzles 51 are symmetrical with a meridian plane along the vertical direction (z direction) being an axis, and the two spray nozzles 51 (51A and 51B) are placed on the upper half side and the two spray nozzles 51 are placed on the lower half side. The spray nozzles 51 inject spray water so that the spray water is conically thrown.

Specifically, on the upper half side, both a first spray nozzle 51A and a second spray nozzle 51B are placed so as to be adjacent to each other with the partition plate 25 interposed therebetween.

The first spray nozzle 51A is located more upward than the turbine rotor 3. Then, the first spray nozzle MA is placed so that the injection port is located more forward than the vertical plane passing through the rotation axis AX of the turbine rotor 3 in the rotation direction R of the turbine rotor 3. That is, the injection port of the first spray nozzle 51A is arranged more forward than the partition plate 25 in the rotation direction R of the turbine rotor 3.

The second spray nozzle 51B is located more upward than the turbine rotor 3 similarly to the first spray nozzle 51A. The second spray nozzle 51B is placed so that the injection port is located more backward than the vertical plane passing through the rotation axis AX of the turbine rotor 3 in the rotation direction R of the turbine rotor 3 differently from the first spray nozzle 51A. That is, the injection port of the second spray nozzle 51B is arranged more backward than the partition plate 25 in the rotation direction R of the turbine rotor 3.

In the rotation direction R of the turbine rotor 3, both a mounting angle θ1 from the vertical plane passing through the rotation axis AX of the turbine rotor 3 to a position where the injection port of the first spray nozzle 51A is mounted and a mounting angle θ2 from the vertical plane passing through the rotation axis AX of the turbine rotor 3 to a position where the injection port of the second spray nozzle 51B is mounted are the same as each other. Each of the mounting angle θ1 of the first spray nozzle 51A and the mounting angle θ2 of the second spray nozzle 51B is, for example, 45° (θ1=θ2=45°). That is, the distance between the injection port of the first spray nozzle 51A and the partition plate 25 and the distance between the injection port of the second spray nozzle 51B and the partition plate 25 are the same as each other.

Each of the first spray nozzle 51A and the second spray nozzle 51B is placed so that the center line J5 of the injection port is along a radial direction of the turbine rotor 3.

Although illustration is omitted, each of the plurality of spray nozzles 51 sprays cooling water supplied from a water supply system (not illustrated) via the connecting pipe 52 as the spray water S5.

The spray nozzle 51 performs spray so that the spray water S5 is conically thrown. When the spray nozzle 51 is an atomization nozzle, a spread angle β of the spray water S5 (spray angle) is 70° or less, and the spray water S5 is thrown, for example, at the spread angle β of 60° (30° each with respect to the center line J5).

Incidentally, it is known that a counter flow area occurs on the rotor blade constituting the turbine stage at the final stage when the steam turbine is operated under the very low load or no load. In addition, at an outlet of the rotor blade at the final stage, a swirl angle becomes large, and high-speed swirling flow occurs in the rotation direction R of the turbine rotor 3.

FIG. 12A and FIG. 12B are diagrams for describing the counter flow area in the steam turbine according to the related art.

FIG. 12A schematically illustrates a stationary blade 310 and the rotor blade 31 constituting the turbine stage at the final stage. FIG. 12A illustrates how high-temperature high-pressure stream is moved to a tip portion of the rotor blade 31 by the centrifugal force on the working fluid, consequently the tip portion becomes high-pressure and a root portion thereof becomes low-pressure, and thus the stream which escaped from the tip portion to the exhaust chamber goes back to the root portion due to a pressure difference, resulting in occurrence of counter flow CF at the root portion of the rotor blade 31. On the other hand, FIG. 12B is a diagram illustrating the relationship between a turbine load and a position where the counter flow area occurs on the rotor blade at the final stage. In FIG. 12B, a horizontal axis represents a turbine load L (%), and a vertical axis represents a position H in a radial direction (refer to FIG. 12A). Specifically, on the vertical axis, a lower side is the root side of the rotor blade and an upper side is the tip side of the rotor blade. In FIG. 12B, a hatched part illustrates a region (corresponding to a region Hr in FIG. 12A) where the counter flow CF occurs.

As can be seen from FIG. 12A and FIG. 12B, as the turbine load L decreases, the steam flows to be biased to the more tip side than the root side on the rotor blade 31 at the final stage, and therefore the region where the counter flow area occurs spreads (refer to FIG. 8).

FIG. 13A and FIG. 13B are diagrams for describing the swirling flow (swirl) which occurs at a blade outlet in the steam turbine according to the related art.

FIG. 13A is a diagram for describing a swirl angle SK and illustrates a cross section of the rotor blade 31 taken along the rotation direction R. In FIG. 13A, a lateral direction is a horizontal direction (y direction) along the rotation axis AX (refer to FIG. 11), and a vertical direction is the rotation direction R. FIG. 13A illustrates a case where the steam which is the working fluid flows from a left side to a right side. Further, FIG. 13B is a diagram illustrating the relationship between the turbine load and the swirl angle, and a horizontal axis represents the turbine load L (%) and a vertical axis represents the swirl angle SK (°).

As can be seen from FIG. 13A and FIG. 13B, the lower the turbine load L (%) becomes, the closer to a direction along the rotation direction R a swirl (swirling flow) comes from a direction along the rotation axis AX. Therefore, when the turbine load L (%) is low, the high-speed swirling flow occurs at the blade outlet at the final stage in the rotation direction R of the turbine rotor 3.

As illustrated in FIG. 13B, when the turbine load L is, for example, in the range Ls of 0 to 17% (spray water supply load), the spray water S5 (water droplets) is supplied.

A part of the spray water S5 which the steam turbine exhaust chamber cooling device 5 supplies to the turbine exhaust chamber K2 flows back in the turbine exhaust chamber K2 due to the above-described occurrence of the counter flow area. Therefore, a part of the spray water S5 which flows back collides with the rotor blade (particularly the root portion) at the final stage, resulting in occurrence of erosion. In order to cope with this event, converting the spray water S5 into fine particles, or the like is proposed.

For example, the spray water S5 is converted into the fine particles by making a diameter of the injection port of the spray nozzle 51 small. When a water droplet diameter of the spray water S5 is small, a specific surface area (=surface area/volume) of the spray water S5 is large in inverse proportion to the water droplet diameter, and thus it is possible to improve cooling efficiency (heat exchange efficiency).

FIG. 14 is a diagram illustrating the relationship between a pressure difference P (kg/cm$^2$), which is a difference between pressure of water supplied to the spray nozzle 51 (supply water pressure) and pressure at an outlet portion of the spray nozzle 51 (outlet pressure), and a water droplet diameter Rd (μm) of the spray water S5 injected from the spray nozzle 51 in the steam turbine according to the related art.

In FIG. 14, the water droplet diameter Rd (μm) is a mathematical average water droplet diameter. Further, in FIG. 14, a line L1 represents the case where a diameter of the injection port is large, and a line L2 represents the case where a diameter of the injection port is smaller than that in the case represented by the line L1.

As illustrated in FIG. 14, the water droplet diameter Rd can be made small when the diameter of the injection port is small (line L2) rather than when the diameter of the injection port is large (line L1). Specifically, when the diameter of the injection port is large (line L1) and the above-described pressure difference P (kg/cm$^2$) is 2.5 to 4.5 kg/cm$^2$, the water droplet diameter Rd (μm) is 350 μm or more. On the other hand, when the diameter of the injection port is small (line L2) and the above-described pressure difference P (kg/cm$^2$) is 4.5 to 9.0 kg/cm$^2$, the water droplet diameter Rd (μm) is 200 μm or less. Note that initial velocity of the water droplet is about 10 m/s when the diameter of the injection port is large (line L1), but it is about 20 m/s when the diameter of the injection port is small (line L2).

FIG. 15 is a diagram illustrating the relationship between a position H of the rotor blade in the radial direction and the water droplet diameter Rd of the spray water S5 and the relationship between the position H of the rotor blade in the radial direction and a heat exchange rate η in the steam turbine according to the related art. On a vertical axis, a lower side is the root side of the rotor blade and an upper side is the tip side of the rotor blade (similarly to those in FIG. 12A). Here, the water droplets of the spray water S5 injected from the spray nozzle 51 are considered to move from an outlet of the spray nozzle 51 while keeping the initial velocity in the radial direction. Further, the heat exchange rate η is represented by volume change in the water droplet.

As can be seen from FIG. 15, because a steam temperature is high at the blade tip portion, a heat exchange amount is large and a decrease in the water droplet diameter is fast (a rate at which the water droplet diameter decreases is large). On the other hand, the closer to the blade root portion, the lower the steam temperature becomes, and thus the heat exchange amount decreases and the decrease in the water droplet diameter becomes slow (the rate at which the water droplet diameter decreases is small).

Specifically, in the water droplet ejected from the spray nozzle 51, the water droplet diameter is, for example, 190 μm. However, the water droplet diameter decreases to 150 μm in the middle of the blade height. Then, when the water droplet reaches the blade root portion, the water droplet diameter becomes as small as 40 μm. The water droplet whose diameter is as small as 50 μm or less causes little erosion even though it collides with the blade.

Further, the heat exchange rate is about 50% in the middle of the blade height. However, the heat exchange rate is 95% at a 10% height from the blade root portion, and the heat exchange rate is about 100% when the water droplet reaches the blade root. Therefore, it is obvious that as long as the water droplet ejected from the spray nozzle 51 reaches the inner peripheral flow guide 24, a sufficient heat exchange is made and little erosion occurs.

Conventionally, the very low load operation or no load operation would not be performed continuously for a long time. Therefore, a spray water quantity is set by giving a reliable decrease in temperature in an exhaust chamber greater importance than erosion which occurs on a blade.

That is, cooling efficiency of steam by using spray water is estimated low and the spray water quantity is set more than a quantity of water required for cooling. As a result, much of the spray water quantity is not effectively used for cooling the temperature of the steam, and hastens the erosion of the blade. The very low load operation or no load operation performed continuously for a long time by this setting method causes significant erosion of the blade. Specifically, due to the above-described counter flow phenomenon (namely, counter flow from an outlet toward an inlet), a part of the spray water collides with an outlet of a blade root portion at a final stage, and the erosion occurs. Further, a part of the spray water collides with an inlet of a blade tip portion and the erosion occurs at the inlet thereof. Then, the collision of a large quantity of the spray water with the blade while the operation is continued for a long time significantly hastens the erosion of the blade, and therefore the operating life of the blade is made short. Consequently, in order to continue the very low load operation or no load operation for a long time, it is necessary to increase the cooling efficiency and decrease a cooling water amount.

FIG. 16 is a view illustrating flow of the spray water S5 which the steam turbine exhaust chamber cooling device 5 supplies to the turbine exhaust chamber K2 in the steam turbine according to the related art.

FIG. 16 illustrates the vertical plane (x-z plane) orthogonal to the rotation axis AX similarly to FIG. 11. However, FIG. 16 illustrates the first spray nozzle 51A, the second spray nozzle 51B, and a third spray nozzle 51C as the spray nozzle 51. Further, in FIG. 16, the flow of the spray water S5 is indicated using solid line arrows. Here, in the spray water S5 which conically diffuses from the spray nozzle 51, besides a water droplet S5*a* injected along the center line J5 of the spray nozzle 51, a water droplet S5*b* injected to a more forward side of the rotation direction R than a direction along the center line J5 and a water droplet S5*c* injected to a more backward side thereof are illustrated. Regarding the first spray nozzle 51A, a water droplet S5*d* (thick alternate long and short dash line) injected between the water droplet S5*a* and the water droplet S5*b* is illustrated therewith.

As illustrated in FIG. 16, the spray water S5 flows to be biased to the forward side (left side in FIG. 16) of the rotation direction R due to the high-speed swirling flow which occurs at the outlet of the turbine stage at the final stage. For example, in the spray water S5, the water droplet S5*a* injected along the center line J5 of the spray nozzle 51 flows to the more forward side of the rotation direction R than the center line J5.

Among the water droplets ejected from the second spray nozzle 51B, the water droplet S5*b* collides with the partition plate 25. A collision position on the partition plate 25 is near the middle of the blade height direction (radial direction). As illustrated in FIG. 15, for example, when the water droplet diameter at a time of the ejection is 190 μm, the water droplet diameter at a time of the collision is 150 μm and the heat exchange rate between the water droplet and the stream is 50%. That is, 50% of the water droplet S5*b* does not contribute to the heat exchange, is captured on the partition plate 25, and is discharged into the steam condenser (not illustrated). As can be seen from the above, among the water droplets ejected from the second spray nozzle 51B, water droplets (not illustrated) which move between the water droplet S5*a* and the water droplet S5*b* do not reach the inner peripheral flow guide 24, resulting in low heat exchange efficiency.

The water droplet S5*b* ejected from the first spray nozzle 51A does not reach the inner peripheral flow guide 24. However, there is not the partition plate 25 on a course of the water droplet S5*b* ejected from the first spray nozzle 51A differently from that of the water droplet S5*b* of the second spray nozzle 51B. Therefore, because the water droplet S5*b* ejected from the first spray nozzle 51A collides with the outer peripheral flow guide 23 after moving in an almost straight-ahead state and is discharged into the steam condenser (not illustrated), the heat exchange efficiency is low. Among the water droplets ejected from the first spray nozzle 51A, a water droplet (for example, a water droplet S5*d*) between the water droplet S5*a* and the water droplet S5*b* collides with the water droplet S5*c* ejected from the third spray nozzle 51C adjacent to the first spray nozzle 51A to combine with each other (D part in the view). This makes the water droplet diameter of the water droplet S5*c* ejected from the third spray nozzle 51C large, and thus the heat exchange efficiency decreases. That is, in order to increase the heat exchange efficiency, it is necessary that the water droplet injected from the spray nozzle 51 reaches the inner peripheral flow guide 24 without colliding with the water droplet injected from the other adjacent spray nozzle 51 and the partition plate 25.

In regions Rfa and Rfb surrounded by dashed lines in FIG. 16, the spray water S5 does not exist, but the region Rfb is cooled by the swirling flow of the steam cooled by the spray water S5 ejected from the second spray nozzle 51B. On the other hand, the region Rfa is not cooled because much of the above-described swirling flow is blocked by the partition plate 25. As described above, reducing a portion where the spray water S5 does not exist to a minimum makes it possible to achieve improvement of the heat exchange efficiency.

When the cooling efficiency (heat exchange efficiency) is low, it is necessary to increase a supply amount of the spray water S5 and it becomes difficult to sufficiently suppress the occurrence of the erosion. Then, it becomes difficult to perform the very low load operation or no load operation for a long time.

There has been proposed a technique to place the spray nozzle so that an injection direction of the spray nozzle is counter to the rotation direction of the turbine rotor and along a tangential direction orthogonal to the radial direction of a rotor. However, by this technique, it is not easy to sufficiently solve the above-described problem.

A problem to be solved by the present invention is to provide a steam turbine exhaust chamber cooling device and a steam turbine which allow improving cooling efficiency (heat exchange efficiency), enable a decrease in a supply amount of spray water and suppression of occurrence of erosion therewith, and further enable the suppression of the occurrence of the erosion by reducing the diameter of a water droplet which collides with a blade.

Figure 5:
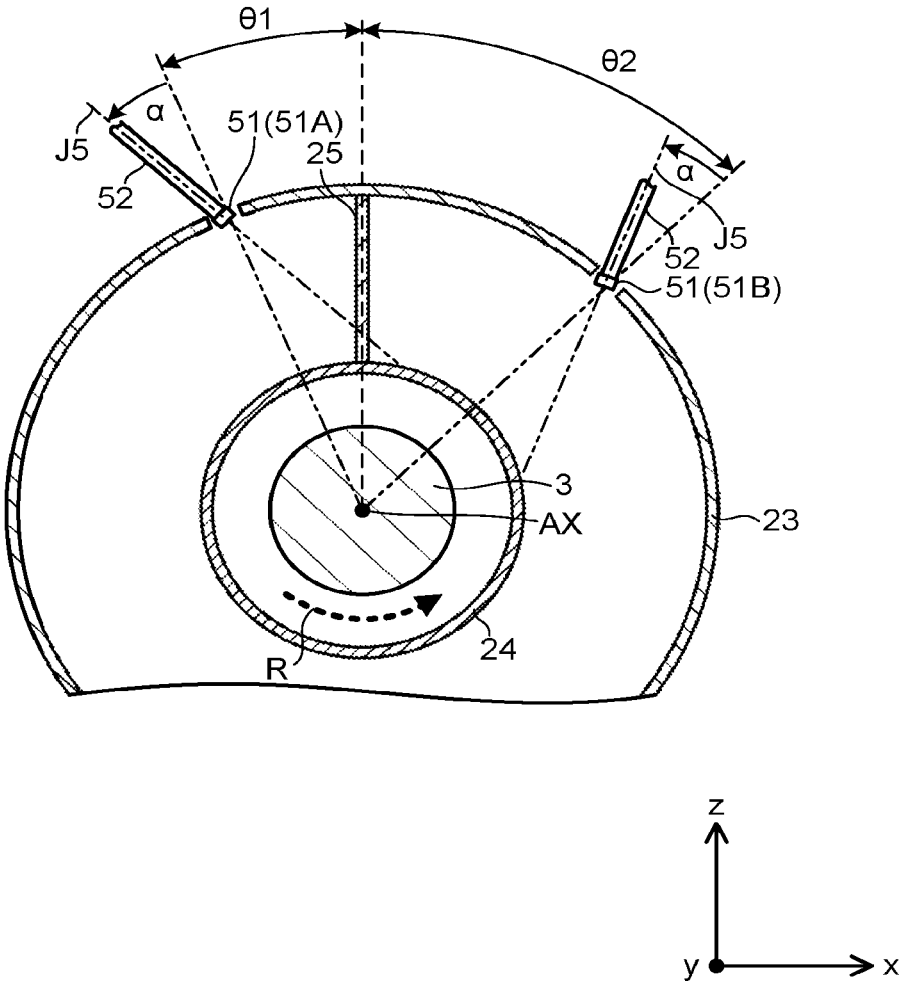

FIG. 5 is a view illustrating a substantial part of a steam turbine according to a second embodiment.

Figure 6:
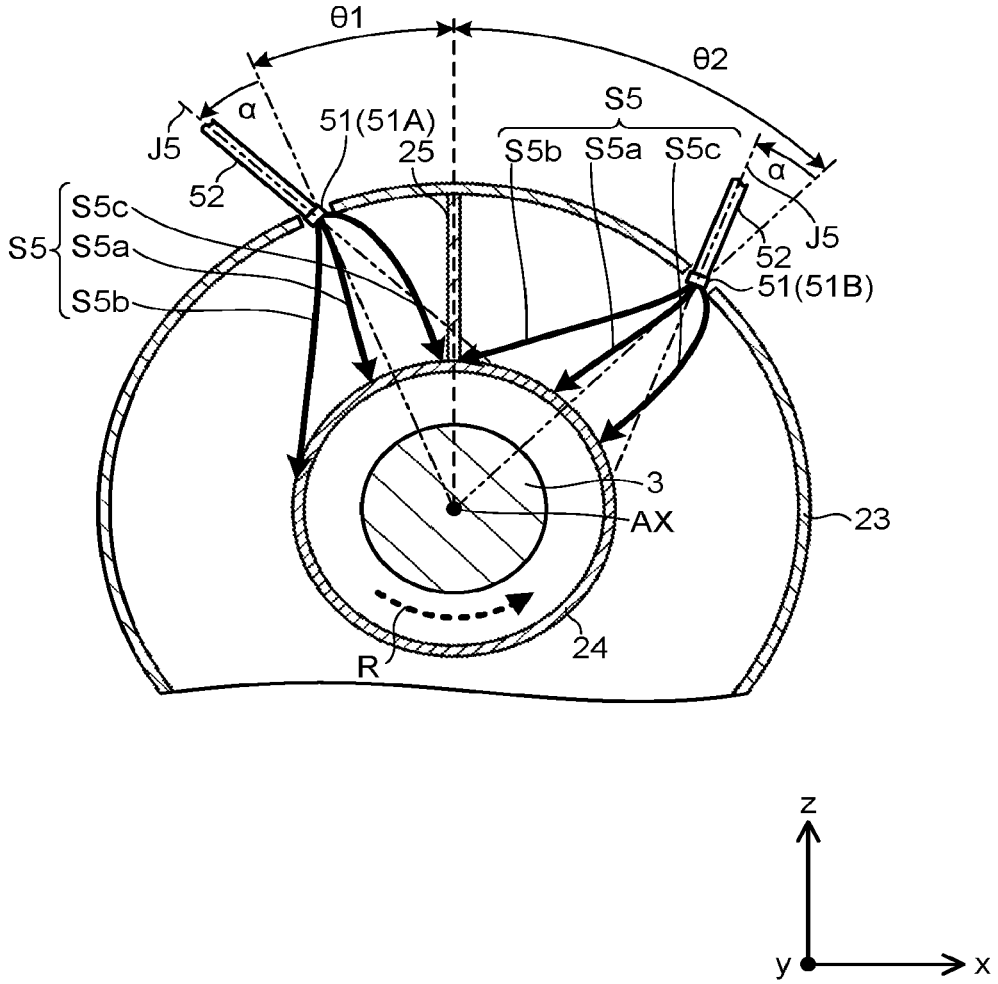

FIG. 6 is a view illustrating flow of spray water S5 which a steam turbine exhaust chamber cooling device 5 supplies to a turbine exhaust chamber K2 in the steam turbine according to the second embodiment.

Figure 7:
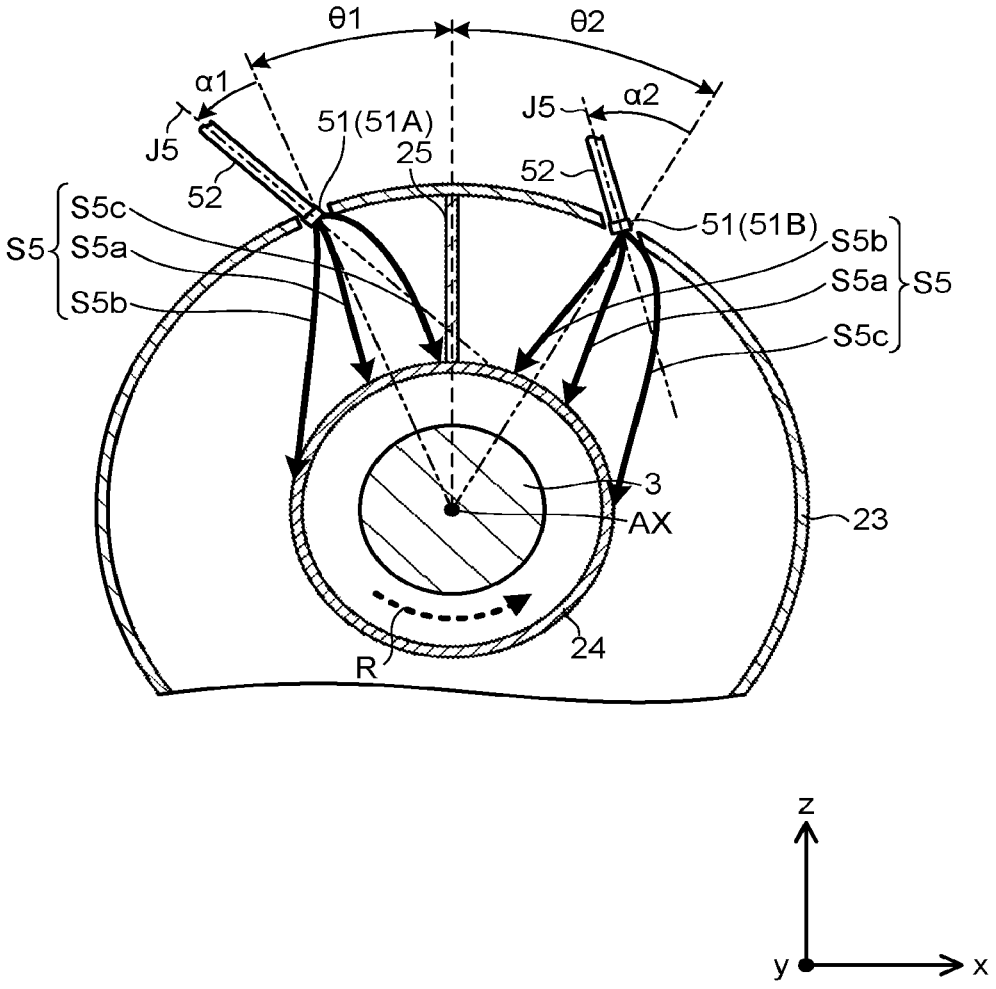

FIG. 7 is a view illustrating a substantial part of a steam turbine according to a modification example of the second embodiment.

Figure 8:
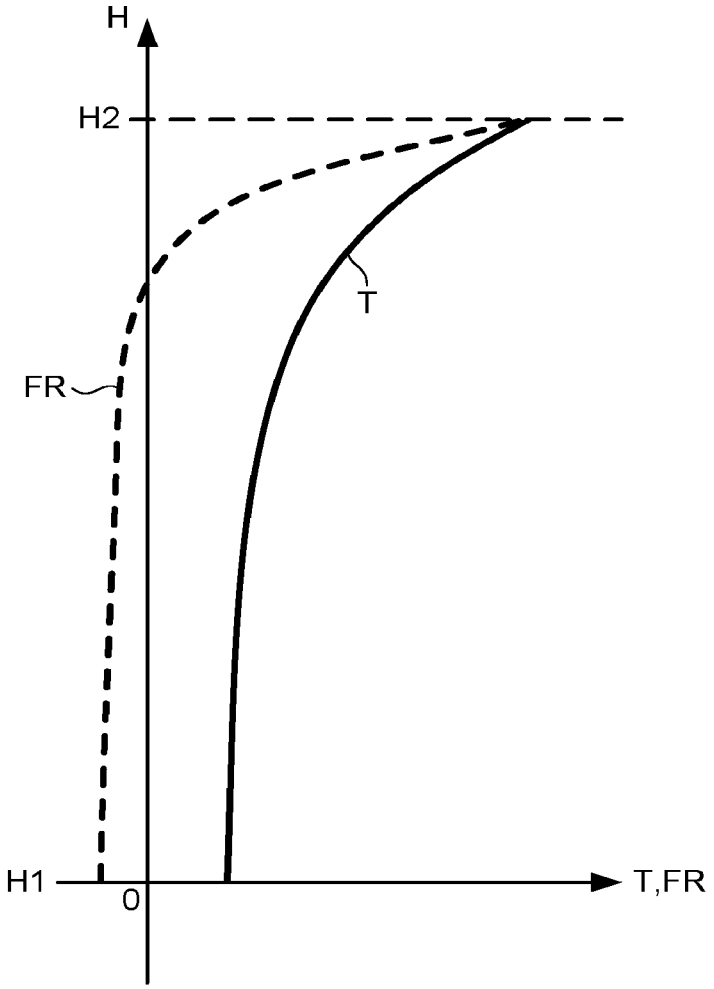
FIG.8 Related Art

FIG. 8 is a diagram illustrating the relationship (temperature distribution) between a temperature T of steam which flows through a rotor blade at a final stage and a position H in a radial direction and the relationship (flow rate distribution) between a flow rate FR of the steam which flows through the rotor blade at the final stage and the position H in the radial direction in a steam turbine according to a related art.

Figure 9:
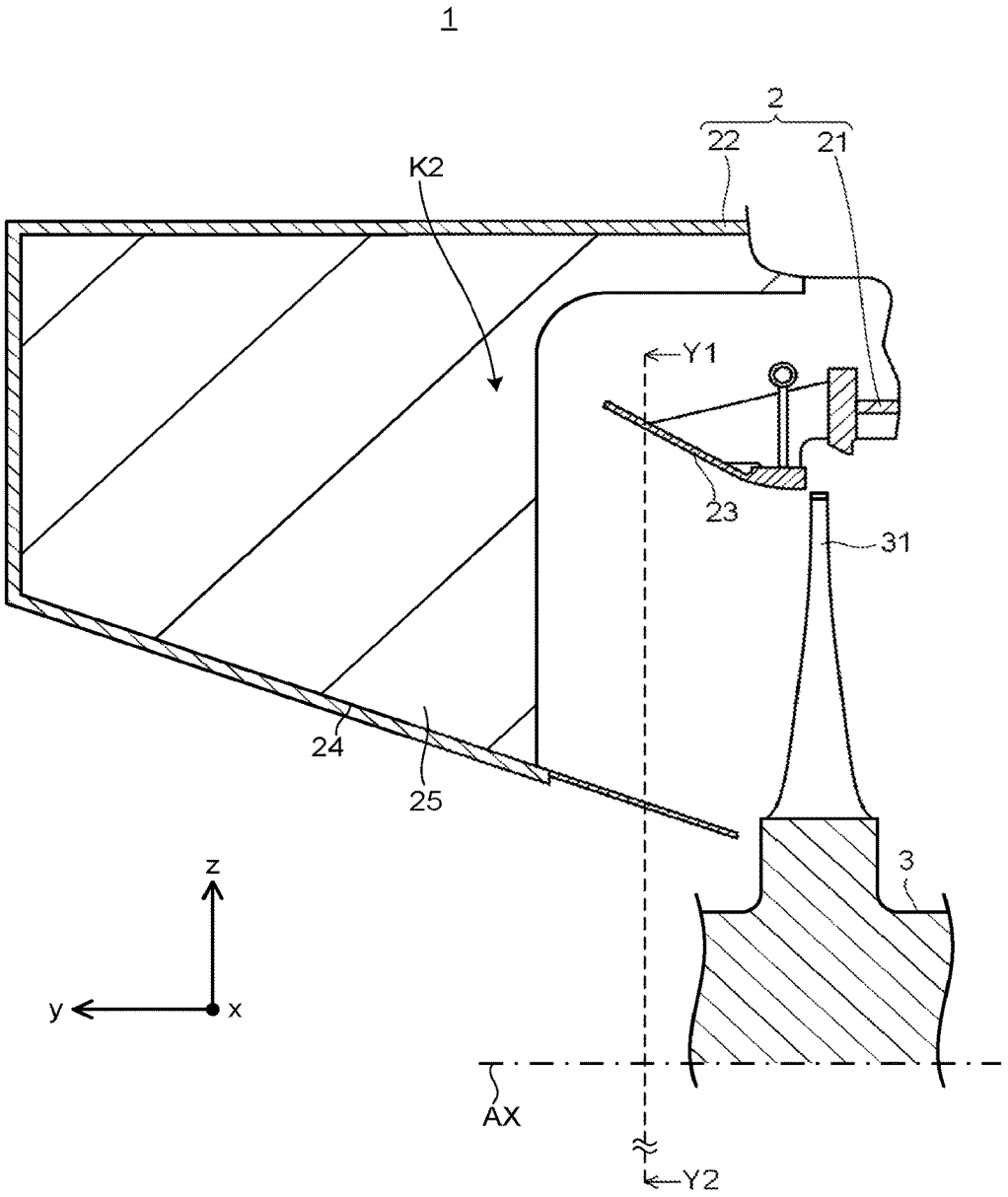
FIG.9 Related Art

FIG. 9 is a view illustrating a substantial part of the steam turbine according to the related art.

Figure 10:
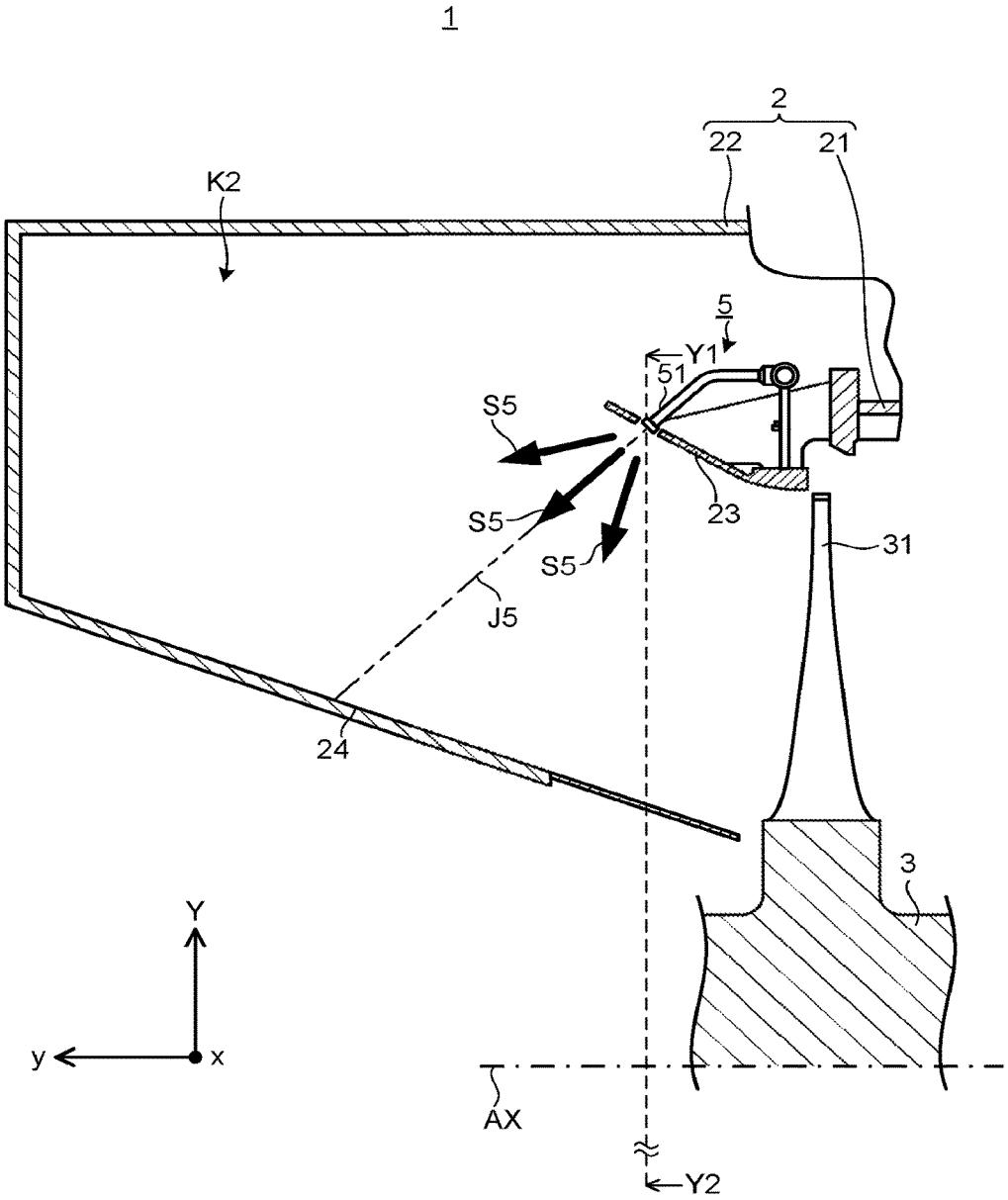
FIG.10 Related Art

FIG. 10 is a view illustrating a substantial part of the steam turbine according to the related art.

Figure 11:
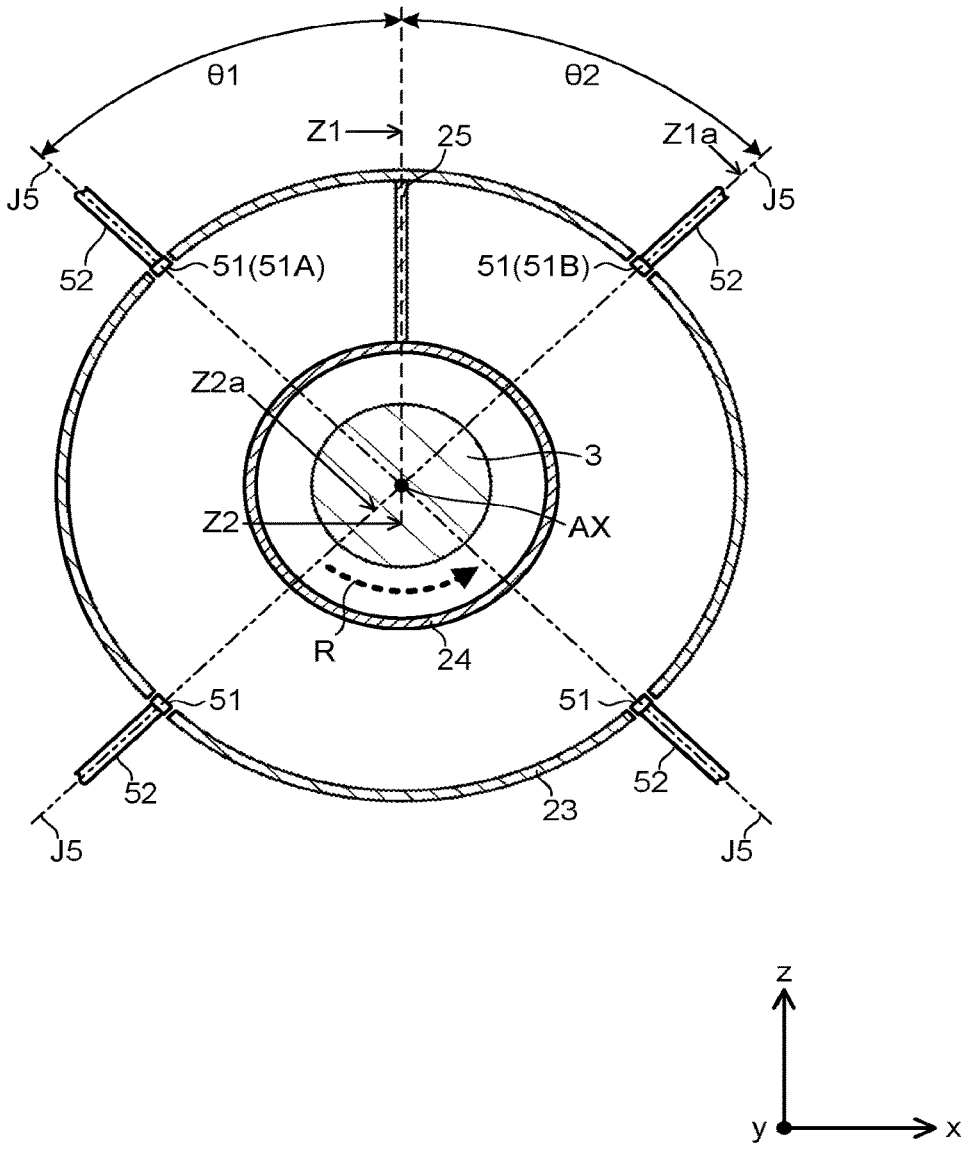
FIG.11 Related Art

FIG. 11 is a view illustrating a substantial part of the steam turbine according to the related art.

Figure 12A:
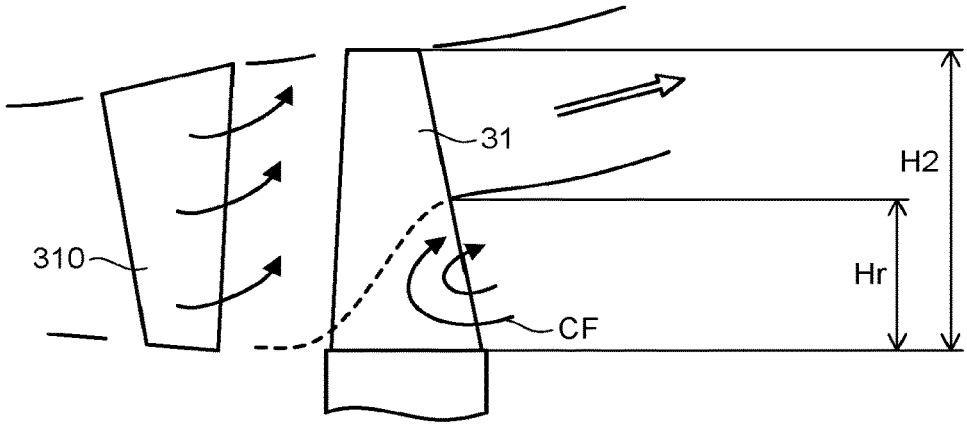
FIG.12A Related Art

FIG. 12A is a diagram for describing a counter flow area in the steam turbine according to the related art.

Figure 12B:
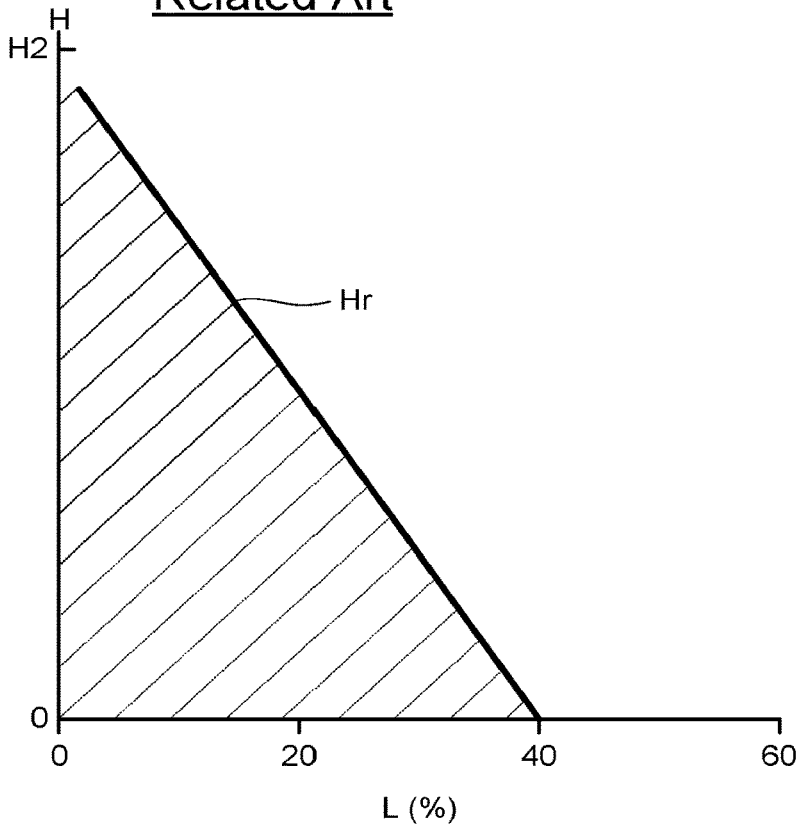
FIG.12B Related Art

FIG. 12B is a diagram for describing the counter flow area in the steam turbine according to the related art.

Figure 13A:
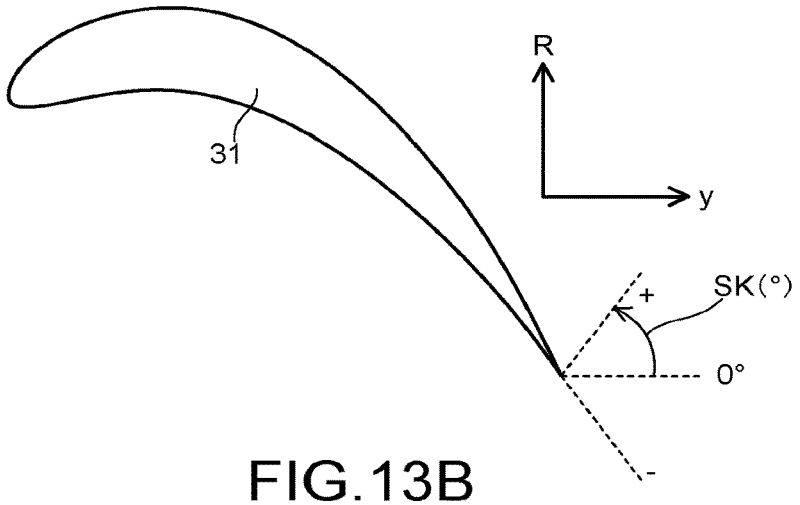
FIG.13A Related Art

FIG. 13A is a diagram for describing swirling flow (swirl) in the steam turbine according to the related art.

Figure 13B:
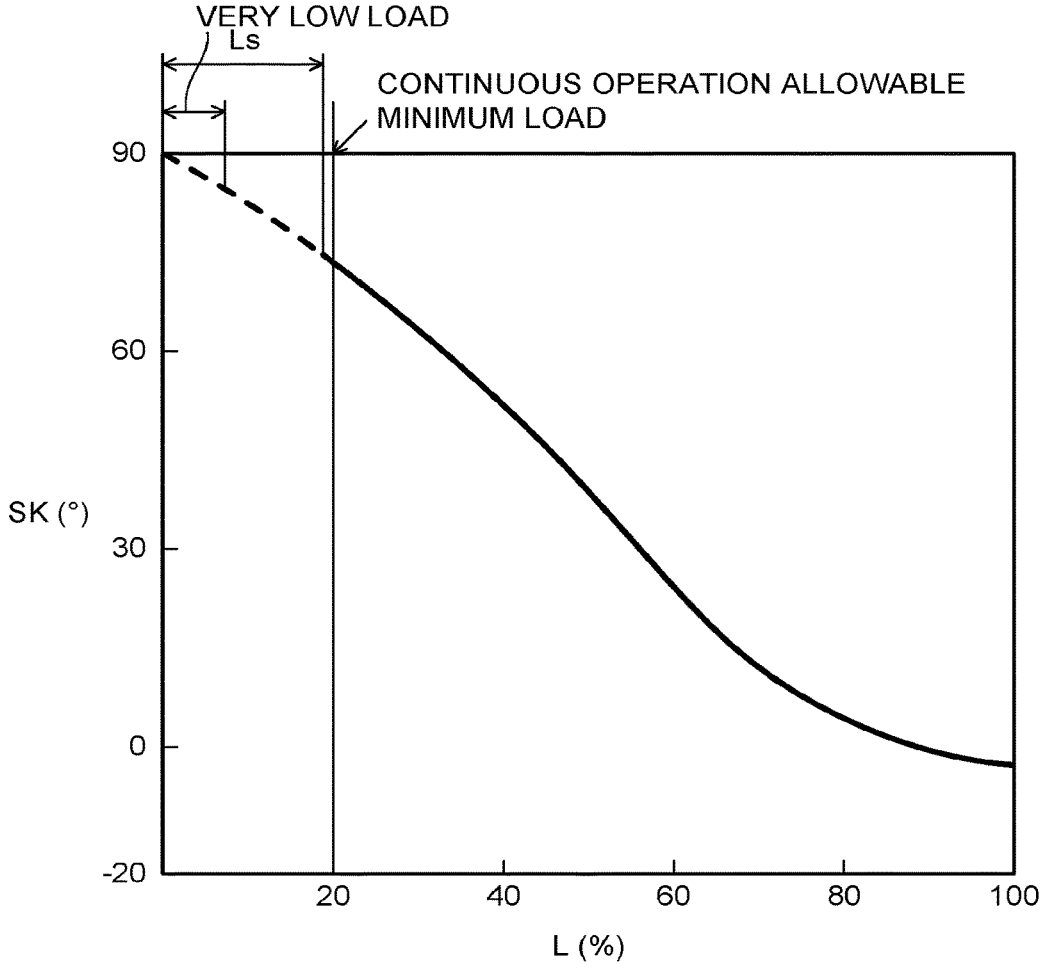
FIG.13B Related Art

FIG. 13B is a diagram for describing the swirling flow (swirl) in the steam turbine according to the related art.

Figure 14:
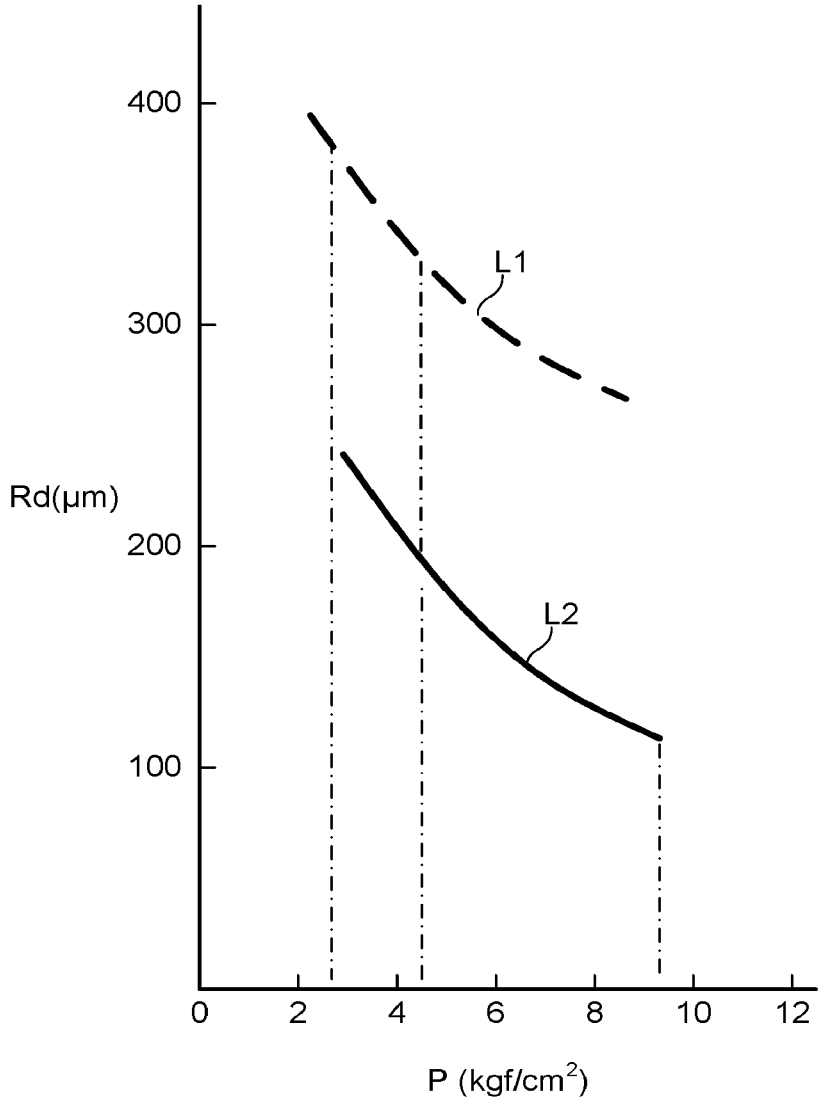
FIG.14 Related Art

FIG. 14 is a diagram illustrating the relationship between a pressure difference P (supply water pressure), which is a difference between pressure of water supplied to a spray nozzle 51 (supply water pressure) and pressure at an outlet portion of the spray nozzle 51 (outlet pressure), and a water droplet diameter Rd of the spray water S5 injected from the spray nozzle 51 in the steam turbine according to the related art.

Figure 15:
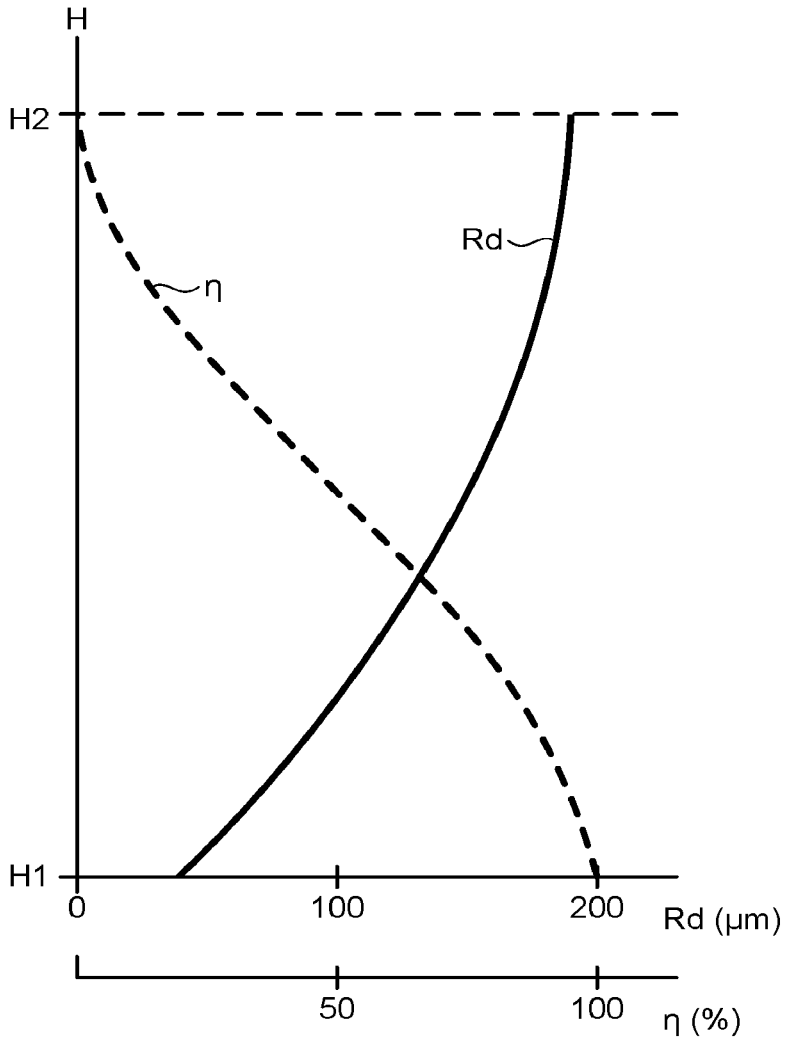
FIG.15 Related Art

FIG. 15 is a diagram illustrating the relationship between a position H of the rotor blade in the radial direction and the water droplet diameter Rd of the spray water S5 and the relationship between the position H of the rotor blade in the radial direction and a heat exchange rate $\eta$ in the steam turbine according to the related art.

Figure 16:
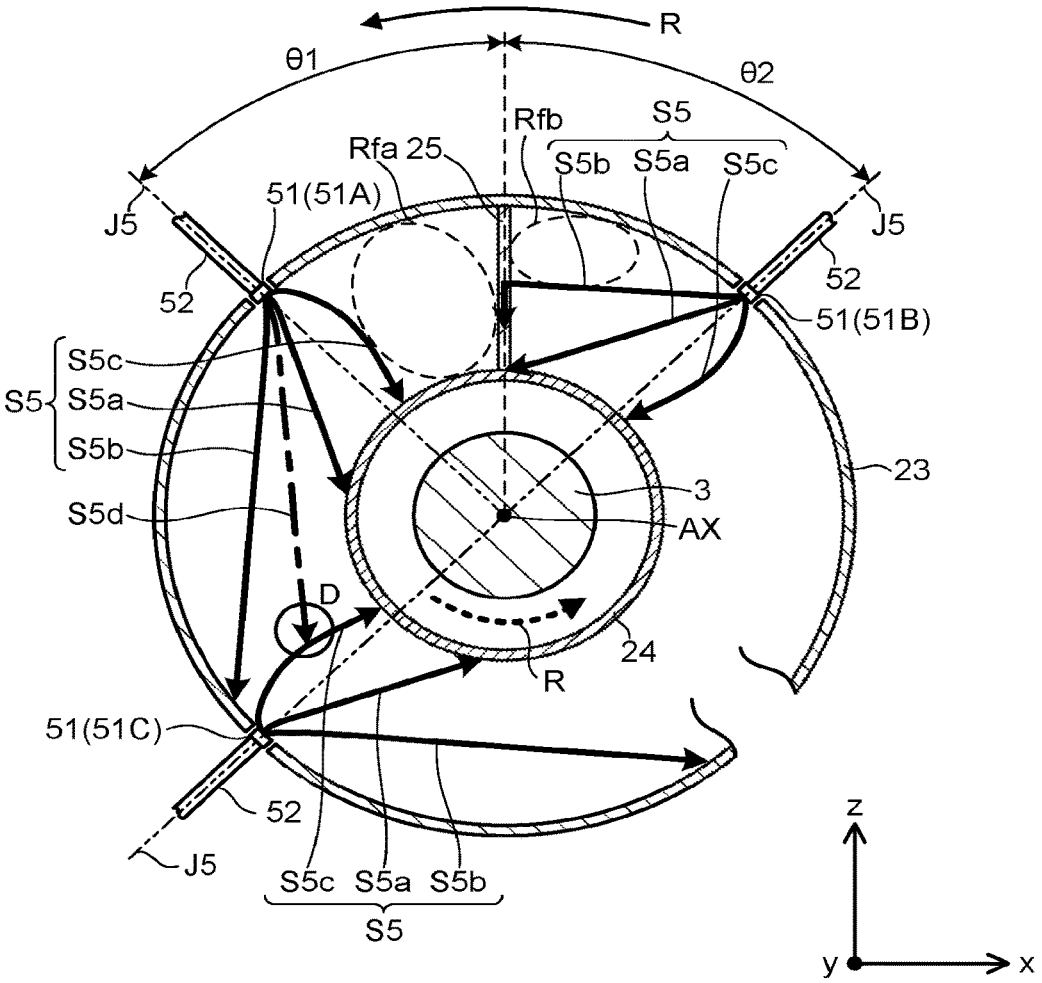
FIG.16 Related Art

FIG. 16 is a view illustrating flow of the spray water S5 which a steam turbine exhaust chamber cooling device 5 supplies to a turbine exhaust chamber K2 in the steam turbine according to the related art.

DETAILED DESCRIPTION

A steam turbine exhaust chamber cooling device of an embodiment supplies spray water to a turbine exhaust chamber to which steam is exhausted from a turbine stage inside a casing housing a turbine rotor. The steam turbine exhaust chamber cooling device includes a plurality of spray nozzles, and the plurality of spray nozzles inject the spray water from an injection port to the turbine exhaust chamber. Here, a center line of the injection port is inclined with respect to a radial direction of the turbine rotor so that the plurality of spray nozzles inject the spray water in a direction counter to a rotation direction of the turbine rotor. An inclination angle $\alpha$ at which the center line of the injection port is inclined to a forward side of the rotation direction with respect to the radial direction of the turbine rotor is in a relationship represented by the following formula (A).

$$25° \leq \alpha \leq 45° \quad (A)$$

Embodiments will be described with reference to the drawings.

First Embodiment

Figure 1:
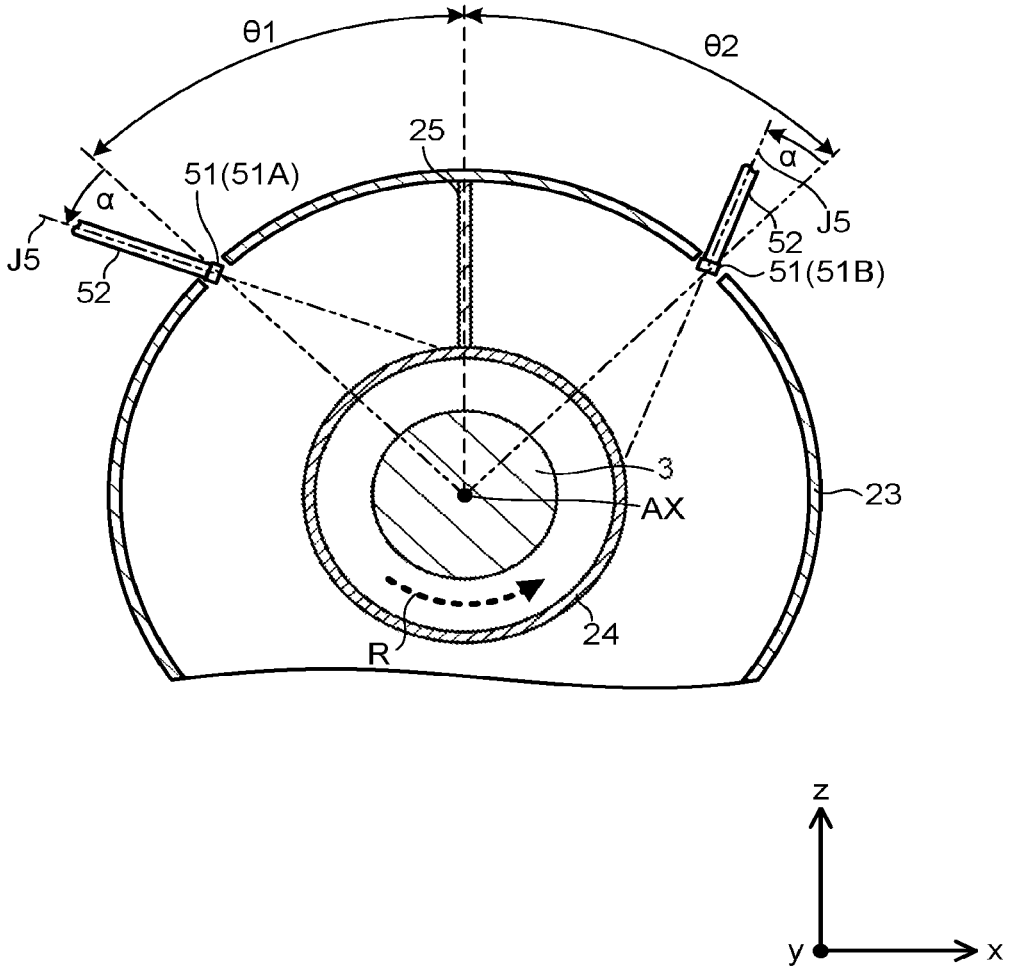
FIG. 1 is a view illustrating a substantial part of a steam turbine according to a first embodiment.

FIG. 1 is a view illustrating a substantial part of a steam turbine according to a first embodiment.

In FIG. 1, similarly to FIG. 11, a cross section of a vertical plane (x-z plane) orthogonal to a rotation axis AX is illustrated and a rotation direction R of a turbine rotor 3 is indicated using a dotted line arrow. However, FIG. 1 illustrates two spray nozzles 51 (a first spray nozzle 51A and a second spray nozzle 51B) placed on an upper half side.

Although illustration is omitted, a steam turbine 1 according to this embodiment has a casing 2, a turbine rotor 3, and a steam turbine exhaust chamber cooling device 5, as in the case of the above-described related art (refer to FIG. 9 and FIG. 10). However, in this embodiment, as illustrated in FIG. 1, an arrangement of the spray nozzles 51 (the first spray nozzle 51A and the second spray nozzle 51B) constituting the steam turbine exhaust chamber cooling device 5 is different from that in the above-described related art (refer to FIG. 11). This embodiment is the same as the case in the above-described related art except the above-described point and related points. Therefore, in this embodiment, descriptions of parts overlapping with those in the above-described related art will be omitted when appropriate.

In this embodiment, the spray nozzle 51 is placed at the tip of a connecting pipe 52 as illustrated in FIG. 1, as in the case of the related art (refer to FIG. 11). Here, the spray nozzle 51 is constructed so as to spray minute water droplets whose diameter is 200 μm or less, for example. The connecting pipe 52 is coaxial with an injection port of the spray nozzle 51.

Further, there are a plurality of spray nozzles 51, and in the plurality of spray nozzles 51, the injection ports are symmetrically arranged with a vertical direction (z direction) passing through a rotation axis AX of the turbine rotor 3 being a symmetrical axis. Specifically, the first spray nozzle 51A and the second spray nozzle 51B are placed on the upper half side, as in the case of the related art (refer to FIG. 11). A mounting angle $\theta$1 of the first spray nozzle 51A and a mounting angle $\theta$2 of the second spray nozzle 51B are the same as each other, and each of them is, for example, 45° ($\theta$1=$\theta$2=45°).

However, in this embodiment, each of the first spray nozzle 51A and the second spray nozzle 51B is not placed so that a center line J5 of the injection port is along a radial direction of the turbine rotor 3, unlike the case of the related art (refer to FIG. 11). In other words, in this embodiment, an extension line extending the center line J5 of the injection port and the rotation axis AX (rotation center) do not cross each other.

In this embodiment, the center line J5 of the injection port is inclined with respect to the radial direction of the turbine rotor 3 so that each of the first spray nozzle 51A and the second spray nozzle 51B injects spray water S5 (not illustrated in FIG. 1) in a direction counter to the rotation direction R. That is, in each of the first spray nozzle 51A and the second spray nozzle 51B, the center line J5 of the injection port is inclined to a forward side of the rotation direction R with respect to the radial direction of the turbine rotor 3.

Specifically, an inclination angle α at which the center line J5 of the injection port is inclined to the forward side of the rotation direction R with respect to the radial direction of the turbine rotor 3 is 0° in the related art (refer to FIG. 11) (α=0), while in this embodiment, it is different from that in the related art. In this embodiment, the inclination angles α are the same as each other in the first spray nozzle 51A and the second spray nozzle 51B, and its minimum value is 25° (α=25°) and its maximum value is 45° (α=45°). That is, the inclination angle α is in a relationship represented by the following formula (A).

$$25° \leq \alpha \leq 45° \quad \text{(A)}$$

Note that the inclination angles α may be the same or different in the first spray nozzle 51A and the second spray nozzle 51B.

Operations and effects of the steam turbine exhaust chamber cooling device 5 according to this embodiment will be described.

Figure 2:
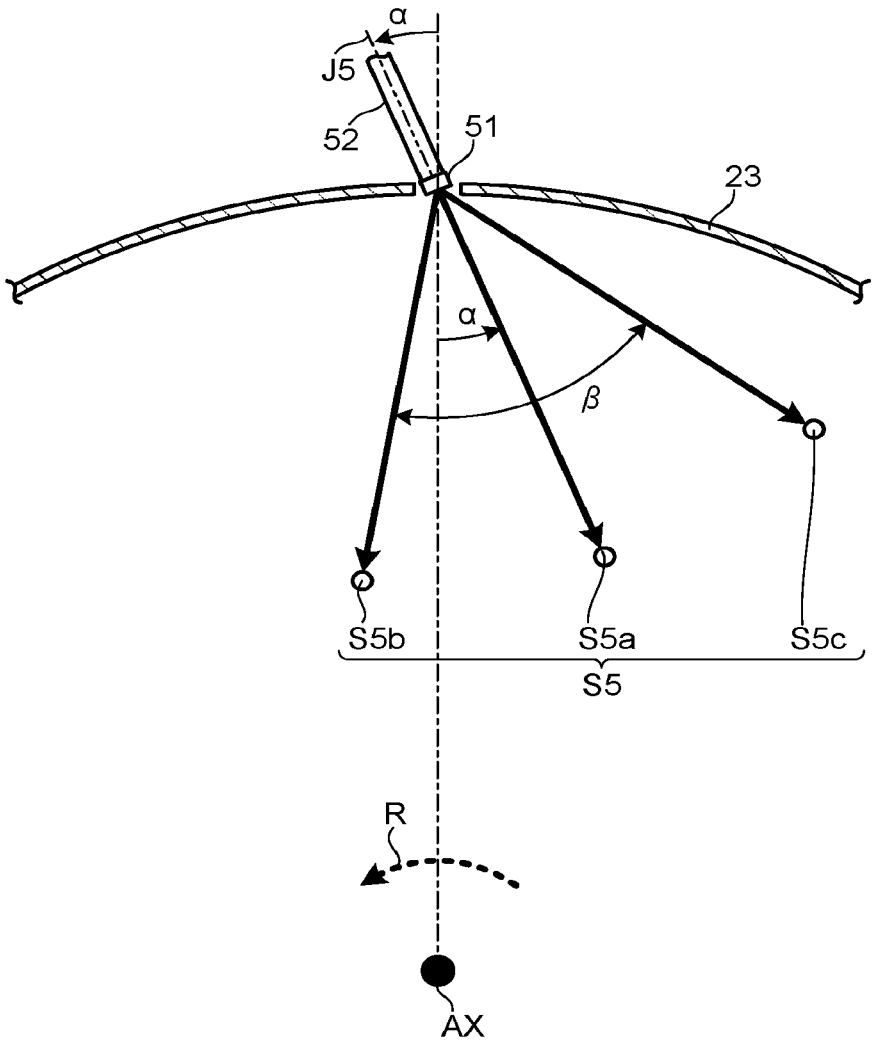
FIG. 2 is a view illustrating flow of spray water S5 which a steam turbine exhaust chamber cooling device 5 supplies to a turbine exhaust chamber K2 in the steam turbine according to the first embodiment.
Figure 3:
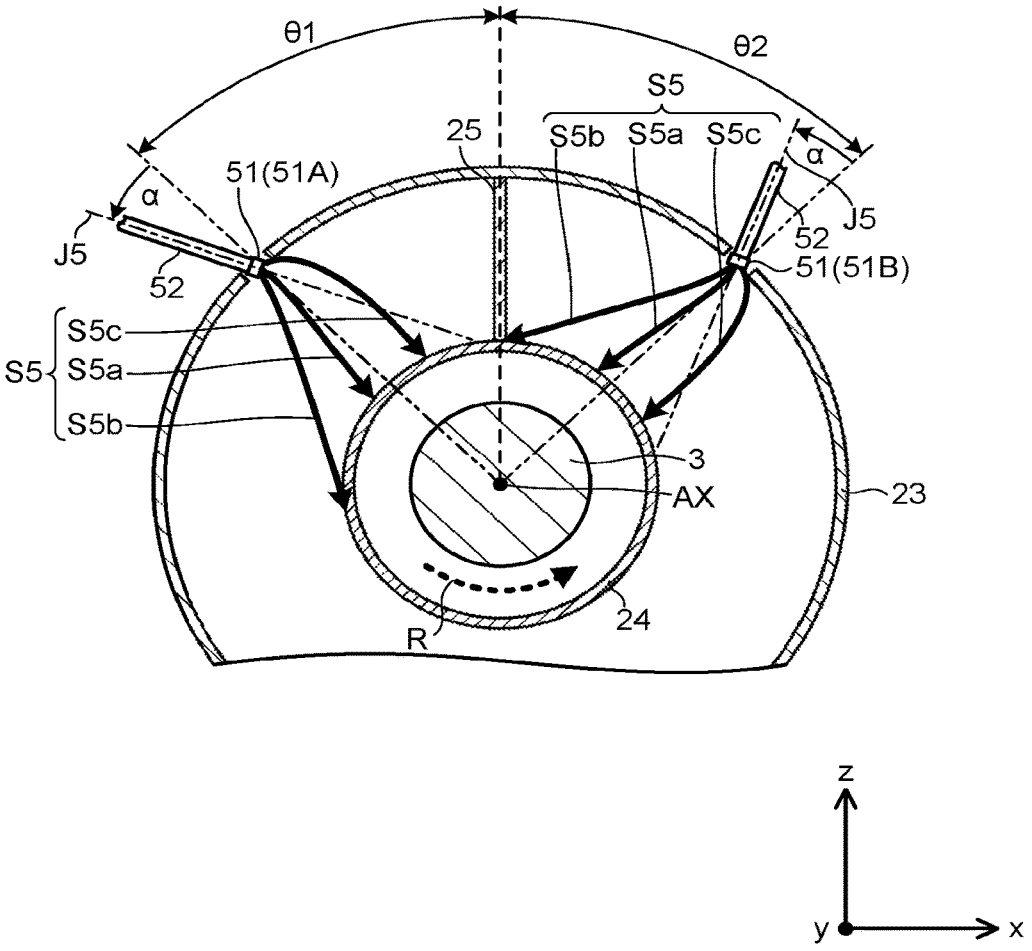
FIG. 3 is a view illustrating the flow of the spray water S5 which the steam turbine exhaust chamber cooling device 5 supplies to the turbine exhaust chamber K2 in the steam turbine according to the first embodiment.
Figure 4:
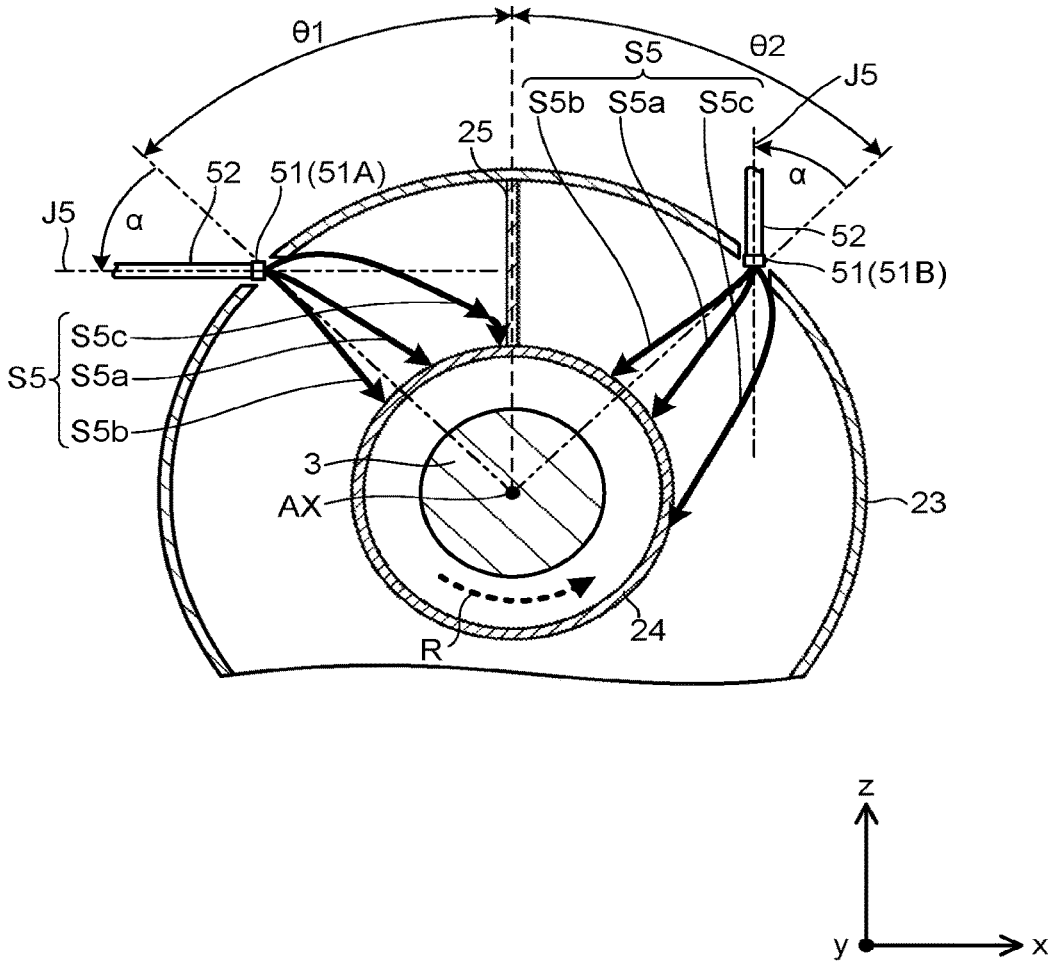
FIG. 4 is a view illustrating the flow of the spray water S5 which the steam turbine exhaust chamber cooling device 5 supplies to the turbine exhaust chamber K2 in the steam turbine according to the first embodiment.

FIG. 2, FIG. 3, and FIG. 4 are views illustrating flow of the spray water S5 which the steam turbine exhaust chamber cooling device 5 supplies to a turbine exhaust chamber K2 in the steam turbine according to the first embodiment.

In FIG. 2 to FIG. 4, the vertical plane (x-z plane) orthogonal to the rotation axis AX is illustrated similarly to FIG. 1. In FIG. 2 to FIG. 4, the flow of the spray water S5 is indicated using solid line arrows. FIG. 2 illustrates a state of the spray water S5 which the spray nozzle 51 injects when operation of the steam turbine 1 is halted and steam which is working fluid does not flow. On the other hand, FIG. 3 and FIG. 4 each illustrate a state of the spray water S5 which the spray nozzles 51 inject when operation is performed under a very low load (for example, 5% load with respect to 100% rated load) or no load in the steam turbine 1. FIG. 3 illustrates that the inclination angle α is 25° which is the minimum value and FIG. 4 illustrates that the inclination angle α is 45° which is the maximum value. Note that in FIG. 2, a longitudinal direction is not a vertical direction but a radial direction differently from FIG. 3, and a placement portion of the spray nozzle 51 is illustrated to be enlarged.

As illustrated in FIG. 2, the spray nozzle 51 performs spray so that the spray water S5 conically diffuses. The spray nozzle 51 performs the spray of the spray water S5 at a spray angle β of 60°, for example. Specifically, in the state where operation of the steam turbine 1 is halted, a water droplet S5*a* is injected along the center line J5 of the injection port of the spray nozzle 51. Besides the above, a water droplet S5*b* is injected to a more forward side of the rotation direction R than a direction along the center line J5 of the injection port and at the same time a water droplet S5*c* is injected to a more backward side of the rotation direction R than the direction along the center line J5 of the injection port. In this embodiment, the water droplet S5*a* injected along the center line J5 of the injection port goes to a direction inclined to the forward side of the rotation direction R with respect to the radial direction of the rotation axis AX.

As illustrated in FIG. 3 and FIG. 4, in the state where the operation is performed under the very low load or no load in the steam turbine 1, the spray water S5 flows to be biased to the forward side of the rotation direction R (left side in FIG. 3) due to high-speed swirling flow which occurs at an outlet of a turbine stage at a final stage, as in the case of the related art (refer to FIG. 16). For example, in the spray water S5, the water droplet S5*a* injected along the center line J5 of the injection port of the spray nozzle 51 flows to the more forward side of the rotation direction R than the center line J5.

However, in this embodiment, unlike the case of the related art (refer to FIG. 16), the first spray nozzle 51A and the second spray nozzle 51B are provided to be inclined as described above. Therefore, all of the spray water S5 (water droplets S5*a*, S5*b*, and S5*c*) injected from them reaches an inner peripheral flow guide 24 and cools the vicinity of a blade root.

Consequently, in this embodiment, because cooling is sufficiently performed, it is possible to improve cooling efficiency (heat exchange efficiency). Then, in accordance with the above, it is possible to decrease a supply amount of the spray water S5. That is, a cooling water amount can be reduced. Accordingly, because the water droplet which collides with a rotor blade 31 decreases, it is possible to effectively suppress occurrence of erosion. As a result, in this embodiment, longer operating life of the rotor blade 31 can be achieved, and it is possible to perform the very low load operation or no load operation for a long time. Note that when the inclination angle α is smaller than the above-described minimum value (25°), the spray water S5 in a front side of the rotor rotation direction does not reach the inner peripheral flow guide 24 as illustrated by the water droplet S5*b* in FIG. 3 and a problem in that a heat exchange amount is reduced occurs. Further, when the inclination angle α is larger than the above-described maximum value (45°), the spray water in a back side of the rotor rotation direction does not reach the inner peripheral flow guide 24 as illustrated by the water droplet S5*c* in FIG. 4 and a problem in that the heat exchange amount is reduced occurs.

Note that in this embodiment, the case where two spray nozzles 51 are placed on the upper half side has been described, but this is not restrictive.

Second Embodiment

FIG. 5 is a view illustrating a substantial part of a steam turbine according to a second embodiment.

In FIG. 5, similarly to FIG. 1, a cross section of a vertical plane (x-z plane) orthogonal to a rotation axis AX is illustrated and a rotation direction R of a turbine rotor 3 is indicated using a dotted line arrow. FIG. 5 illustrates two spray nozzles 51 (a first spray nozzle 51A and a second spray nozzle 51B) placed on an upper half side similarly to FIG. 1.

In this embodiment, as illustrated in FIG. 5, an arrangement of the spray nozzles 51 (the first spray nozzle 51A and the second spray nozzle 51B) constituting a steam turbine exhaust chamber cooling device 5 is different from that in the above-described first embodiment. This embodiment is the same as the first embodiment except the above-described point and related points. Therefore, in this embodiment, descriptions of parts overlapping with those in the above-described related art will be omitted when appropriate.

In this embodiment, the spray nozzle 51 is placed at the tip of a connecting pipe 52 as illustrated in FIG. 5, as in the case of the first embodiment. Here, the spray nozzle 51 is constructed so as to spray minute water droplets whose diameter is 200 μm or less, for example. The connecting pipe 52 is coaxial with an injection port of the spray nozzle 51.

Further, in this embodiment, a plurality of spray nozzles 51 are placed on an outer peripheral flow guide 23, as in the case of the first embodiment. Specifically, on the upper half side, the first spray nozzle 51A is placed more forward than a partition plate 25 in the rotation direction R of the turbine rotor 3. In addition, the second spray nozzle 51B is placed more backward than the partition plate 25 in the rotation direction R of the turbine rotor 3.

Each of the first spray nozzle 51A and the second spray nozzle 51B is not placed so that a center line J5 of the injection port is along a radial direction of the turbine rotor 3, as in the case of the first embodiment. In this embodiment, the center line J5 of the injection port is inclined with respect to the radial direction of the turbine rotor 3 so that each of the first spray nozzle 51A and the second spray nozzle 51B injects spray water S5 (not illustrated in FIG. 5) in a direction counter to the rotation direction R. That is, in each of the first spray nozzle 51A and the second spray nozzle 51B, the center line J5 of the injection port is inclined to a forward side of the rotation direction R with respect to the radial direction of the turbine rotor 3. FIG. 5 illustrates that an inclination angle $\alpha$ is 25° which is a minimum value, but the inclination angle $\alpha$ may be in the range of 25° which is the minimum value to 45° which is a maximum value as represented by the above-described formula (A).

However, in this embodiment, in the first spray nozzle 51A and the second spray nozzle 51B, the injection ports are not symmetrically arranged with a vertical direction (z direction) passing through a rotation axis AX of the turbine rotor 3 being a symmetrical axis.

Specifically, in the rotation direction R of the turbine rotor 3, a mounting angle $\theta 1$ from a vertical plane passing through the rotation axis AX of the turbine rotor 3 to a position where the injection port of the first spray nozzle 51A is mounted and a mounting angle $\theta 2$ from the vertical plane passing through the rotation axis AX of the turbine rotor 3 to a position where the injection port of the second spray nozzle 51B is mounted are different from each other ($\theta 1 \neq \theta 2$). Here, the mounting angle $\theta 1$ of the first spray nozzle 51A and the mounting angle $\theta 2$ of the second spray nozzle 51B are in a relationship represented by the following formula (B). That is, the mounting angle $\theta 1$ of the first spray nozzle 51A is smaller than the mounting angle $\theta 2$ of the second spray nozzle 51B.

$$\theta 1 < \theta 2 \quad \text{(B)}$$

In other words, the distance between the injection port of the first spray nozzle 51A and the partition plate 25 is shorter than the distance between the injection port of the second spray nozzle 51B and the partition plate 25. FIG. 5 illustrates that the mounting angle $\theta 1$ of the first spray nozzle 51A is 20° and the mounting angle $\theta 2$ of the second spray nozzle 51B is 45°.

Operations and effects of a steam turbine exhaust chamber cooling device 5 according to this embodiment will be described.

FIG. 6 is a view illustrating flow of the spray water S5 which the steam turbine exhaust chamber cooling device 5 supplies to a turbine exhaust chamber K2 in the steam turbine according to the second embodiment.

FIG. 6 illustrates the vertical plane (x-z plane) orthogonal to the rotation axis AX similarly to FIG. 5. In FIG. 6, the flow of the spray water S5 is indicated using solid line arrows. Here, in the spray water S5 which conically diffuses from the spray nozzle 51, besides a water droplet S5*a* injected at an angle with respect to the center line J5 of the spray nozzle 51, a water droplet S5*b* injected to a more forward side of the rotation direction R than a direction along the center line J5 and a water droplet S5*c* injected to a more backward side thereof are illustrated.

As illustrated in FIG. 6, the spray water S5 flows to be biased to the forward side of the rotation direction R due to high-speed swirling flow which occurs at an outlet of a turbine stage at a final stage, as in the case of the first embodiment. For example, in the spray water S5, the water droplet S5*a* injected at an angle with respect to the center line J5 of the spray nozzle 51 flows to the more forward side of the rotation direction R than the center line J5.

However, in this embodiment, the first spray nozzle 51A located more forward than the partition plate 25 in the rotation direction R is closer to the partition plate 25 than that in the first embodiment. The spray water S5 injected from the first spray nozzle 51A does not collide with the partition plate 25, and more water droplets (in the range of the water droplet S5*a* to the water droplet S5*c*) than those in the first embodiment reach an inner peripheral flow guide 24 and contribute to cooling.

Further, in this embodiment, the operation of the spray water S5 injected from the first spray nozzle 51A makes the range Rfa (not illustrated in FIG. 6) illustrated in FIG. 16 small. That is, a dead zone located more forward in the rotation direction R than the partition plate 25 and not supplied with a cooling medium such as the spray water S5 becomes small.

Furthermore, in this embodiment, the spray water S5 does not collide with and is not captured on the partition plate 25, and therefore it is possible to improve cooling efficiency. Further, in this embodiment, because the water droplet ejected from the spray nozzle 51 does not collide with the water droplet ejected from the other adjacent spray nozzle 51 and does not become coarse, it is possible to improve the cooling efficiency.

Consequently, in this embodiment, because the cooling is sufficiently performed, it is possible to improve the cooling efficiency (heat exchange efficiency). Then, in accordance with the above, it is possible to reduce a supply amount of the spray water S5. Then, a decrease in the water droplets which collide with a rotor blade 31 and a sufficiently small diameter of the colliding water droplets make it possible to effectively suppress occurrence of erosion. As a result, in this embodiment, longer operating life of the rotor blade 31 can be achieved, and it is possible to perform the very low load operation or no load operation for a long time.

Note that in this embodiment, the case where two spray nozzles 51 are placed on the upper half side has been described, but this is not restrictive. For example, the number of spray nozzles placed more forward than the partition plate 25 in the rotation direction R and the number of spray nozzles placed more backward than the partition plate 25 in the rotation direction R may be different from each other. That is, the number of spray nozzles placed more forward than the partition plate 25 in the rotation direction R may be more than the number of spray nozzles placed more backward than the partition plate 25 in the rotation direction R. Further, the number of spray nozzles placed more forward than the partition plate 25 in the rotation direction R may be fewer than the number of spray nozzles placed more backward than the partition plate 25 in the rotation direction R.

Further, in the above-described embodiment, the case where the inclination angle $\alpha$ of the first spray nozzle 51A and the inclination angle $\alpha$ of the second spray nozzle 51B are the same as each other has been described, but this is not restrictive. The inclination angles $\alpha$ may be different from each other in the first spray nozzle 51A and the second spray nozzle 51B.

FIG. 7 is a view illustrating a substantial part of a steam turbine according to a modification example of the second embodiment. FIG. 7 illustrates the vertical plane (x-z plane) orthogonal to the rotation axis AX similarly to FIG. 6.

This modification example illustrates a case where the mounting angle θ1 of the first spray nozzle 51A is 20° and the mounting angle θ2 of the second spray nozzle 51B is 25°. Further, in this modification example, both the inclination angle α1 of the first spray nozzle 51A and the inclination angle α2 of the second spray nozzle 51B are different from each other. Here, the inclination angle α1 of the first spray nozzle 51A is 25° and the inclination angle α2 of the second spray nozzle 51B is 45°.

In this modification example, similarly to the above-described second embodiment, the operation of the spray water S5 injected from the first spray nozzle 51A makes the range Rfa (not illustrated in FIG. 6) illustrated in FIG. 16 small. That is, a dead zone located more forward in the rotation direction R than the partition plate 25 and not supplied with a cooling medium such as the spray water S5 becomes small.

Furthermore, in this modification example, similarly to the above-described second embodiment, because the spray water S5 does not collide with and is not captured on the partition plate 25, it is possible to improve the cooling efficiency. Further, in this modification example, because the water droplet ejected from the spray nozzle 51 does not collide with the water droplet ejected from the other adjacent spray nozzle 51 and does not become coarse, it is possible to improve the cooling efficiency.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A steam turbine exhaust chamber cooling device for supplying spray water to a turbine exhaust chamber to which steam is exhausted from a turbine stage inside a casing housing a turbine rotor, the device comprising:

a plurality of spray nozzles each having a respective injection port for injecting the spray water to the turbine exhaust chamber, wherein at a cross section of a vertical plane orthogonal to a rotation axis of the turbine rotor, a respective center line of a respective injection port is inclined with respect to a radial direction of the turbine rotor, the radial direction connecting the respective injection port with the rotation axis of the turbine rotor, so that the plurality of spray nozzles inject the spray water in a direction counter to a rotation direction of the turbine rotor; and inclination angles α at which the center lines of all the injection ports are inclined to a forward side of the rotation direction with respect to the radial direction of the turbine rotor are in a relationship represented by a following formula (A), $$25° \leq \alpha \leq 45° \quad \text{(A).}$$

2. The steam turbine exhaust chamber cooling device according to claim 1, wherein the plurality of spray nozzles include:

a first spray nozzle located more upward than the turbine rotor and placed more forward in the rotation direction of the turbine rotor than a partition plate placed along a vertical plane passing through a rotation axis of the turbine rotor; and a second spray nozzle located more upward than the turbine rotor and placed more backward than the partition plate in the rotation direction of the turbine rotor, and in the rotation direction of the turbine rotor, a mounting angle θ1 from the vertical plane passing through the rotation axis of the turbine rotor to a position where the injection port of the first spray nozzle is mounted and a mounting angle θ2 from the vertical plane passing through the rotation axis of the turbine rotor to a position where the injection port of the second spray nozzle is mounted are in a relationship represented by a following formula (B), $$\theta 1 < \theta 2 \quad \text{(B).}$$

3. A steam turbine comprising the steam turbine exhaust chamber cooling device according to claim 1.

* * * * *